US007235754B2

(12) United States Patent
Rochon et al.

(10) Patent No.: US 7,235,754 B2
(45) Date of Patent: Jun. 26, 2007

(54) SWITCH DEVICE PROVIDED WITH A LIGHT SOURCE

(75) Inventors: Sylvain Rochon, Dole (FR); Laurent Bouvier, Monniers (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/363,815

(22) Filed: Feb. 28, 2006

(65) Prior Publication Data

US 2006/0191779 A1 Aug. 31, 2006

Related U.S. Application Data

(63) Continuation-in-part of application No. PCT/IB04/02939, filed on Sep. 10, 2004.

(30) Foreign Application Priority Data

Sep. 12, 2003 (FR) ..... 03 10752

(51) Int. Cl.
*H01H 5/30* (2006.01)
*H01H 9/18* (2006.01)

(52) U.S. Cl. ..... 200/406; 200/314

(58) Field of Classification Search ..... 200/406, 200/310, 314, 341, 512, 516, 517, 520
See application file for complete search history.

(56) References Cited

U.S. PATENT DOCUMENTS 3,707,609 A 12/1972 Dapot et al.
4,161,637 A * 7/1979 Priesemuth ..... 200/524
4,197,437 A 4/1980 Michalski
4,350,857 A * 9/1982 Fillus et al. ..... 200/314
4,431,879 A * 2/1984 Fujita et al. ..... 200/314
4,439,646 A 3/1984 Bouvrande
4,488,020 A 12/1984 Zalewski et al.
4,563,550 A * 1/1986 Bertina ..... 200/5 A
4,933,523 A * 6/1990 Honda et al. ..... 200/526
5,095,184 A * 3/1992 Zemp et al. ..... 200/314
5,534,840 A * 7/1996 Cuingnet ..... 200/314
5,895,901 A 4/1999 Watanabe et al.
6,140,596 A * 10/2000 Tsay ..... 200/406

FOREIGN PATENT DOCUMENTS

DE 29 14 709 A1 10/1980
DE 198 17 239 A1 10/1999
GB 786 404 11/1957
GB 1 326 172 8/1973
JP 61-208708 9/1986

* cited by examiner

*Primary Examiner*—Michael A. Friedhofer
(74) *Attorney, Agent, or Firm*—Peter Van Winkle

(57) ABSTRACT

A casing (3), in which a plurality of conductive tracks are fixed, an operation element (5) which is arranged so as to be able to move in translation in the casing (3), a conductive dome-like member (51) which is arranged in the casing (3) and which is resiliently deformable under the action of the displacement of the operation element (5) between a first state and a second state of commutation, a light source (13) and at least two power supply tracks for the light source (13). The light source (13) is fixedly joined to the operation element (5), the operation element being provided with at least two contact elements (87) which connect, over the entire axial travel of the operation element (5) in the casing (3), the light source (13) to the respective power supply tracks.

6 Claims, 3 Drawing Sheets

SWITCH DEVICE PROVIDED WITH A LIGHT SOURCE

CROSS-REFERENCE

This is a continuation-in-part of PCT application PCT/IB2004/002939 filed 10 Sep. 2004, which designates the US and which claimed priority from French application 0310752 filed 12 Sep. 2003.

BACKGROUND OF THE INVENTION

The present invention relates to a switch device of the type comprising:

a casing, in which a plurality of conductive tracks are fixed, an operation element which is arranged so as to be able to move in translation in the casing along an activation axis, a conductive dome-like member which is arranged in the casing and which is resiliently deformable, under the action of the displacement of the operation element, between a rest state corresponding to a first state of commutation of the device and at least one deformed state corresponding to a second state of commutation of the device, a light source and at least two power supply tracks for the light source, which tracks are fixed in the casing.

Switches of this type are known in the prior art and are sometimes referred to as "dome type switches", in which the light source (generally a light-emitting diode or LED) is fixed to the casing. The light source generally comprises pins which are soldered to power supply tracks fixedly joined to the casing.

In such devices which are in particular used in producing keypad type switches of electrical devices, a translucent button which is fixedly joined to the operation element covers the light source. The device is activated by a user pressing on the translucent button in such a manner that the position of the translucent button with respect to the light source varies in accordance with the commutation state of the switch device.

In the case, for example, of a light source which is permanently supplied with power, whatever the state of the switch device, the user may perceive a variation in the luminosity of the source when the button is depressed.

The object of the invention is to overcome this disadvantage and the invention relates to a switch device of the above-mentioned type, in which changes in the state of the device, or more generally the displacement of the operation element in the casing, do not bring about any variation in the luminosity of the source, as perceived by the user.

SUMMARY OF THE INVENTION

To this end, in a switch device according to the invention, the light source is fixedly joined to the operation element, the operation element being provided with at least two contact elements which connect, over at least a portion of the axial travel of the operation element in the casing, the light source to the respective power supply tracks.

According to specific embodiments of the invention, the switch device comprises one or more of the following features:

the contact elements are provided in order to connect the light source to the power supply tracks over the entire axial travel of the operation element in the casing;

the contact elements of the operation element comprise conductive resilient tabs which project radially, whilst the respective power supply tracks extend axially over internal walls of the casing, in such a manner that a radially outer portion of each resilient tab is in sliding contact with the respective track;

each conductive resilient tab has, at the side of its radially outer portion, two radially projecting connecting pieces which are axially offset relative to each other and which define contact regions with the respective track;

the device comprises a resilient insulating block which is interposed between the conductive dome-like member and the operation element, the insulating block being deformable in axial compression;

the insulating block is arranged in such a manner as to be resiliently deformed in compression over a first travel of the operation element, starting from the rest position, without any substantial deformation of the conductive dome-like member, in accordance with a characteristic effort/depression curve which is substantially linear, until a resilient reaction effort is produced corresponding to a threshold effort for abrupt elastic deformation of the conductive dome-like member;

the insulating block is produced from elastomer material;

the light source has a translucent body which projects at least partially from the operation element and from the casing;

the device comprises a translucent activation button which is fixedly joined to the operation element and which covers the light source;

the casing is formed internally with axial channels and the operation element is formed with corresponding radial projections which are slidingly engaged in those channels;

the casing has a bottom and the conductive dome-like member is formed with radial arms for contact with the bottom of the casing, the free end of each of the arms being engaged in a respective axial channel;

the device comprises a conductive region at the bottom of an axial channel, with which region the free end of a radial arm is in contact in the rest state of the device, and the casing comprises a portion which projects from the bottom in the vicinity of that region and which is located in a radially internal manner relative thereto in such a manner that the corresponding radial arm can be supported and tilt on the projecting portion when the dome-like member is deformed, the free end of the arm then becoming separated from the region; and the device comprises a sealing sheet which is fitted to the casing and which is provided with a hole, through which the operation element projects over the entire axial travel thereof in the casing, the sealing sheet being arranged to ensure sealing between the casing and the operation element.

The invention will be better understood from a reading of the description below which is given purely by way of example and with reference to the drawings.

The novel features of the invention are set forth with particularity in the appended claims. The invention will be best understood from the following description when read in conjunction with the accompanying drawings.

DESCRIPTION OF THE PREFERRED EMBODIMENT

Figure 1:
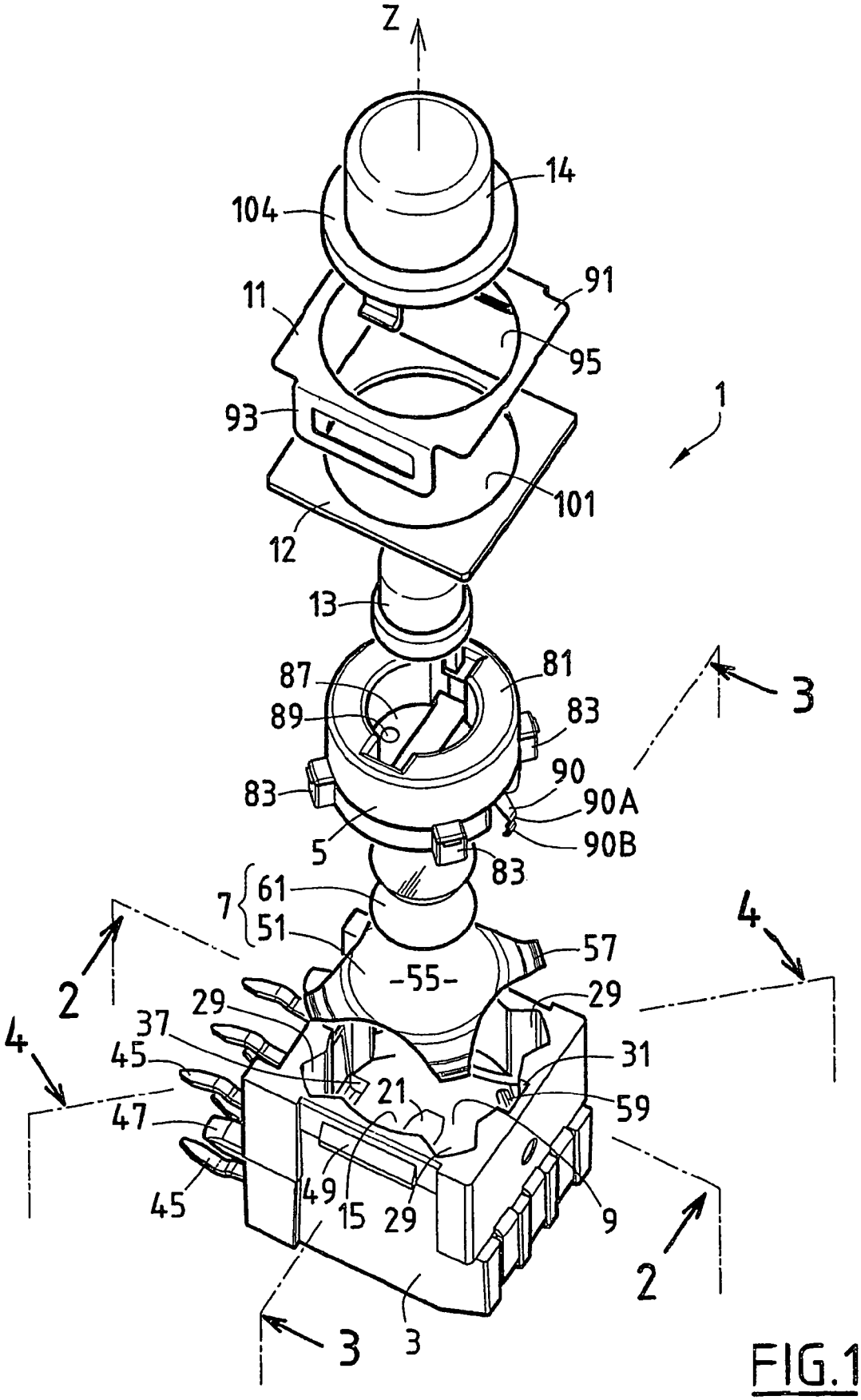
FIG. 1 is an exploded perspective view of a switch device according to the invention.

The switch device 1 illustrated in FIGS. 1 to 4 comprises a casing 3, an operation element 5 which is movable relative to the casing and a switch mechanism 7 which is accommodated in the casing 3.

In the entirety of the description, it will be assumed that the switch device 1 is orientated in such a manner that the operation element 5 is movable in translation relative to the casing 3 along vertical axis Z-Z.

In this orientation, the casing 3 has a bottom 9. The switch mechanism 7 is arranged in the casing 3 between the bottom 9 and the operation element 5.

The switch device 1 further comprises a strap 11 for retaining the switch mechanism 7 and the operation element 5 in the casing 3, a sealing sheet 12 which is interposed between' the strap 11 and the casing 3, a light source 13 which is constituted, in the embodiment illustrated, by a light-emitting diode (LED), and a transparent or translucent push-button 14. This button 14 is separate from the operation element 5, above the light-emitting diode 13, in order to improve the visual appearance and to facilitate the activation by a user when the switch device is installed in electronic equipment. Such a button for a switch device can be provided in particular to constitute a keypad type switch of an electrical device, such as on a driver's console of a motor vehicle.

The casing 3 is of generally parallelepipedal form and internally delimits a housing 15 of generally cylindrical form which is closed at the lower end thereof by the bottom 9.

The casing is produced from insulating plastics material.

A conductive pad 21 extends in a central region of the bottom 9 of the casing.

The generally cylindrical lateral surface of the housing 15 is interrupted by four channels 29 which are angularly offset by 90° about axis Z. These channels 29 extend axially along generating lines of the cylindrical wall.

Figure 4:
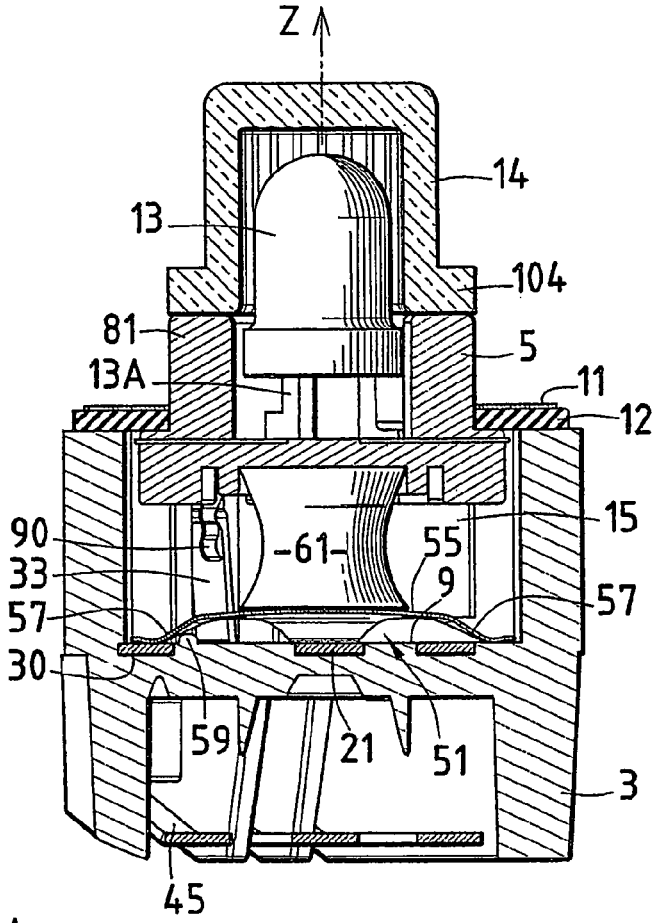
FIG. 4 is a similar view in a diagonal vertical plane in direction 4-4.

Two consecutive channels 29 each have, at the bottom thereof, a conductive region 30, only one of which 5 is visible in FIG. 4. The two regions 30 at the bottom of the channel 29, similarly to the central pad 21, are aligned with the surface of the bottom 9 of the casing.

The lateral surface of the housing 15 is further interrupted by two diametrically opposed grooves 31 of 10 generally rectangular cross-section which extend along axis Z. In the lower portion of each groove, a conductive track 33 which is fitted to the internal wall of the housing 15 of the casing extends vertically.

Recesses 37 are formed in the bottom 9 of the 15 casing at right-angles to the tracks 33.

The casing 3 further comprises a series of conductive terminals 45, in this case six in number, which project in two rows of three from the same lateral face of the casing. In the embodiment illustrated, these terminals 20 45 are in the form of pins of generally rectangular cross-section which taper at the free end thereof and which are intended to be "stapled" to a printed circuit board and connected to conductive tracks, in particular by welding. However, other types of terminal can be provided depending 25 on the type of assembly for which the switch device is intended, for example, surface assembly or panel type assembly.

Each of the central pad 21, the two conductive regions 30 at the bottom of the channel 29 and the tracks 30 33 is electrically connected to one or more of the terminals 45.

In particular, each track 33 constitutes a power supply track for the light source 13 and is connected to a respective power supply terminal 45, the two power supply terminals 45 being constituted here by the two central terminals of the two rows.

At the lateral face of the casing 3, from which the terminals 45 project, two pins 47 for mounting and positioning the casing on a printed circuit board are formed. Furthermore, lugs 49 for attaching the strap 11 are formed at two other lateral faces of the casing 3.

The switch mechanism 7 comprises a resilient conductive dome-like member 51 having a central portion 55 of generally disc-like form, and four arms 57 which project radially downwards from the central portion. These arms 57 are angularly offset by 90° and the free ends thereof are received in the channels 29 and, for two consecutive arms of the arms 57, being in contact with the conductive regions 30 and, for the other two arms 57, being in contact with the insulating bottom 9 of the casing.

The dome-like member 51 is preferably produced from steel in order to confer on it good performance in terms of mechanical strength and resilience, and is preferably further coated by gold plating so as to improve the electrical conductivity thereof.

As is visible in FIG. 4, the bottom 9 of the casing is formed with a projecting low wall 59, in the vicinity of one of the regions 30 and in a radially internal manner with respect to the support region of the corresponding arm 57 on the region 30.

In this manner, when the central portion 55 of the dome-like member is depressed until it comes into contact with the central pad 21, the arm 57 which extends above the wall 59 comes into contact therewith. This produces tilting of the free end of the arm itself, which tends to become separated from the region 30. At the same time, the other arm 57 which is associated with a region 30 at the bottom of the channel 29, in the absence of a similar wall remains in contact at the free end thereof with the corresponding region 30. In this manner, only one of the two regions 30 is electrically connected to the central pad 21 in the "commutated"' (or depressed) state of the device.

The switch mechanism 7 further comprises a resilient insulating block 61 which is interposed between the dome-like member 51 and the operation element 5. This insulating block 61 (FIG. 4) is of a form which is generated by revolution relative to axis Z and which is delimited by two circular planar faces, a lower face and an upper face, and by a lateral surface which is generated by rotation of a curve having concavity directed towards axis Z. In this manner, the insulating block 61 is in the general form of a cylinder having axis Z which is contracted over an intermediate portion of the height thereof. It can be seen that the height or thickness of the insulating block 61 (FIG. 2) is a plurality of times the greatest height of the dome-like member 51.

Whatever the state of the switch device 1, the upper face of the insulating block 61 supports the operation element 5, whilst the lower face thereof is supported on the central portion 55 of the dome-like member.

The insulating block 61, which is preferably produced from elastomer material, such as silicone, is deformable in compression along axis Z depending on the position of the operation element 5 in the casing 3. In this manner, the insulating block 61 defines a resilient spacer between the operation element 5 and the dome-like member 51.

The rigidity of the insulating block 61 in axial compression is such that, over a first depression travel for the operation element 5 in the casing 3, the block 61 deforms in accordance with a characteristic effort/deformation curve which is substantially linear, without any substantial deformation of the dome-like member 51, until a resilient reaction effort is produced corresponding to the effort necessary for bringing about the abrupt deformation of the dome-like member 51.

For example, the conductive dome-like member 51 and the insulating block 61 are formed in such a manner that the first depression travel of the operation element 5 is approximately 0.8 mm and the additional travel after the contact of the dome-like member 51 with the central pad 21 is approximately 1.4 mm under an activation effort of approximately 25 N.

Figure 5:
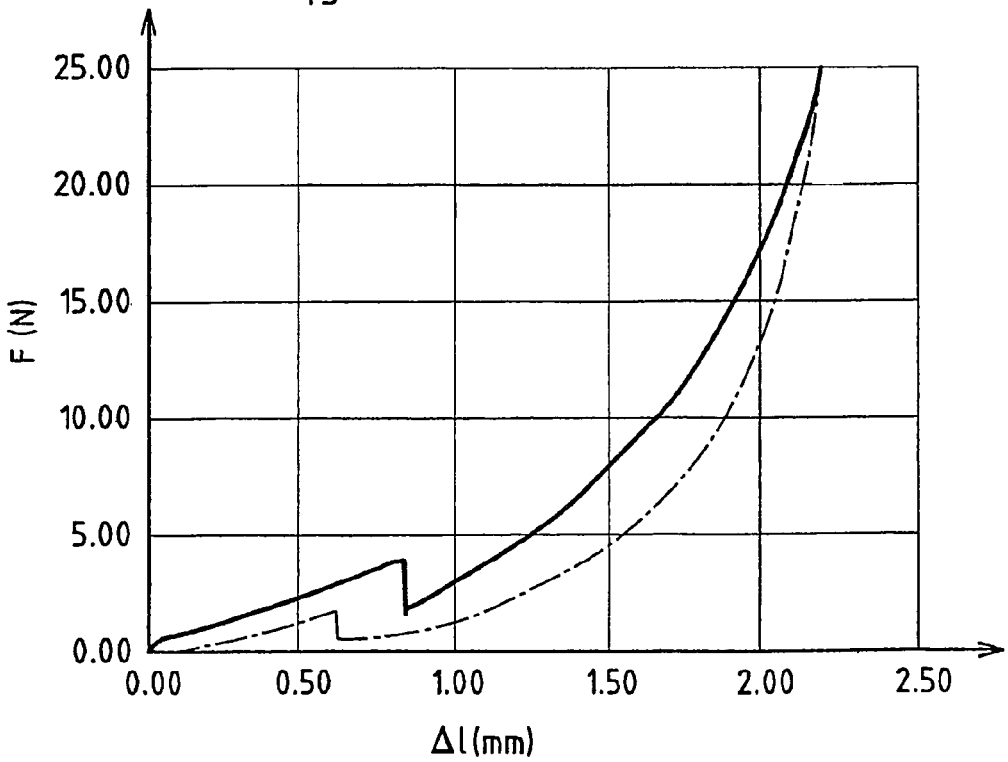
FIG. 5 is a graph showing the activation effort and the resilient reaction effort, respectively, over the depression travel of the operation element and over the inverted retraction travel.

These features are visible in FIG. 5, which will be discussed below.

The operation element 5 comprises a cylindrical ring 81 which is closed at the lower base thereof by a circular plate 82 forming a bottom, and which is fixedly joined, at the periphery thereof, to four radially projecting blocks 83 which are angularly offset by 90° relative to each other about axis Z. These blocks 83 are engaged and can slide axially in the channels 29 in order to prevent any significant rotation of the operation element 5 with respect to the casing 3 about axis Z, whatever the axial position thereof. The ring 81, the bottom 82 and the blocks '83 are preferably produced in one piece from plastics material. A diametral strut 85 is further integrally formed on the bottom 82.

The operation element 5 further comprises two conductive bars 87 which are fitted to the bottom 82 so as to extend at one side and the other of the strut 85 which constitutes an insulating barrier between these two bars. Each bar 87 is provided with an opening 89, in which one of the two pins 13A of the LED is inserted and fixed, respectively. As can be seen in particular in FIG. 2, the insulating strut 85 not only allows the conductive bars 87 to be mutually insulated, but also allows the LED to be precisely secured and positioned on the operation element 5. In this manner, the light source 15 is fixed to the operation element 5.

The conductive bars 87 each have a tab 90 which is folded so as to project radially downwards from the bottom 82 of the operation element 5. These tabs 90 are formed so as to each engage in a groove 31 whilst making contact, in the region of a free end portion, with the respective track 33, in all of the axial positions of the operation element 5 in the casing 3. It will be appreciated that the shape of the tabs 90 which form the contact element and the conductive material which constitutes the bars 87 are provided in order to ensure sufficient contact pressure on the tracks 33 to bring about good electrical conduction between the tracks 33 and the tabs 90.

It will be appreciated that the tabs 90 ensure, with the tracks 33, sliding contact which is capable of allowing the light source 13 to be supplied with power over the entirety of the axial travel of the operation element 5.

In a more precise manner, each tab 90 is provided, at the side of the radially outer free end thereof, with two radially projecting connecting pieces, or projections 90A, 90B. These two connecting pieces 90A, 90B define regions of contact with the respective track 33 which is inclined from the axis Z. They are axially offset so that one and/or the other makes contact with the track 33 depending on the axial position of the operation element 5. In the rest position of the device, that is to say, in a position at the start of the travel of the operation element, only the lower connecting piece 90B makes contact with the respective track 33, whilst in the position at the end of the travel of the operation element, only the upper connecting piece 90A makes contact with the track 33. The free end of the tab 90 and the lower connecting piece 90B are then located in the respective recess 37.

Owing to this arrangement, it is possible to provide a shorter track than in an arrangement in which a single point of sliding contact brings about permanent contact over the entire activation travel. In this manner, this arrangement, providing two offset regions of contact with the tabs 90, allows a switch device which is more compact in terms of height to be produced. In other words, this arrangement allows, for a given length of the tracks 33, a travel for the operation element 5 to be obtained which is greater than this given length, with the electrical power supply of the LED 13 being ensured over the entire travel.

Figure 2:
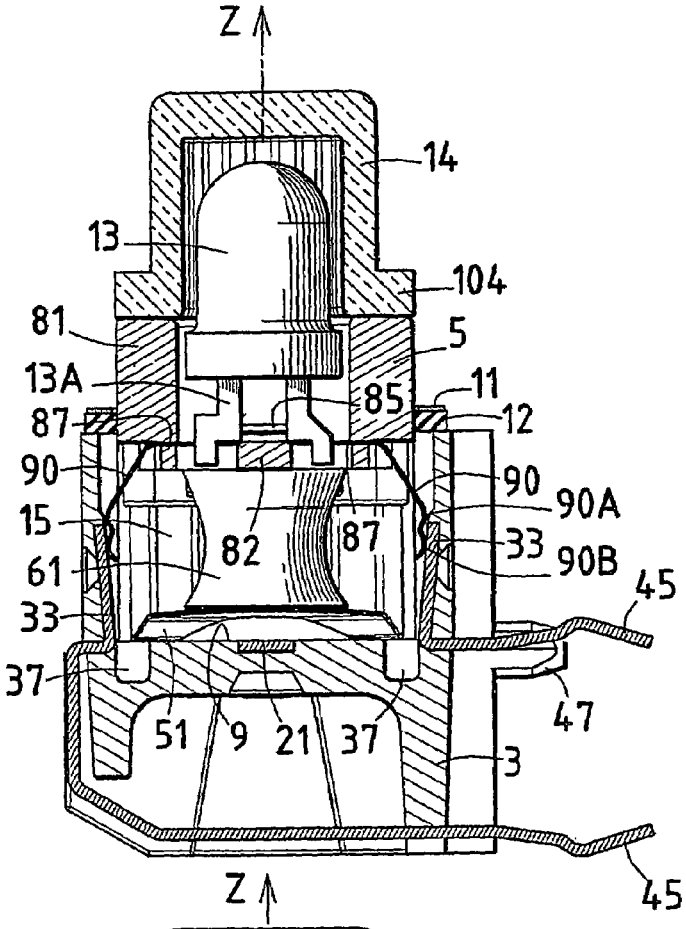
FIG. 2 is a sectioned view in a vertical center plane in direction 2-2 of the assembled switch device of FIG. 1.
Figure 3:
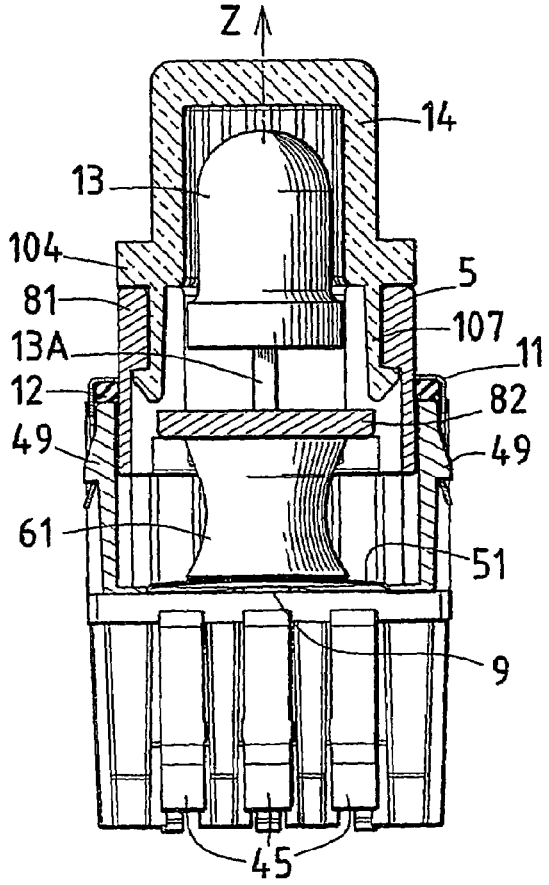
FIG. 3 is a similar view in a vertical center plane which is orthogonal to the plane of FIG. 2 in direction 3-3.

It will be appreciated that the upper surface of the ring 81 is raised relative to the blocks 83, which allows the ring 81 to project from the casing 3, as is visible in FIGS. 2 and 3, in the rest position of the device, whilst the blocks 83 are engaged in the respective recesses 40.

The strap 11 is formed by a planar plate 91 of generally square form, the outer edges of which substantially coincide with those of the upper surface of the casing 3, and is provided with lateral tabs 93 which are folded down perpendicularly. Each of these lateral tabs 93 is hollowed out so as to be able to engage over one of the lugs 49. In this manner, the strap 11 can be resiliently engaged, along axis Z, on the casing 3 by the attachment means which are constituted by the lugs 49, on the one hand, and complementary lateral tabs 93, on the other hand. The planar plate 91 is formed with a central through-hole 95 of circular form and having dimensions corresponding to the outside diameter of the ring 81.

In a corresponding manner, the sealing sheet 12 is of generally square form having substantially the same dimensions as those of has a circular central hole 101 which coincides with the hole 95.

The button 14 is of a generally hollow-cylindrical form which can receive internally an upper portion of the LED 13, and is provided at the base thereof with a collar 104, from which two downwardly projecting opposing arms 107 are formed. These arms 107 allow the button 14 to be fixed to the operation element 5 by means of cooperation with a peripheral shoulder of the ring 81. The collar 104 is then supported on the upper surface of the ring 81.

The assembled device in its rest state will now be described in greater detail with reference to FIGS. 2 to 4.

In this configuration, the dome-like member 51 rests at the bottom of the casing 3, by the radially outer end of the arms 57 (FIG. 4) being in contact with the conductive regions 30 at the bottom of the channel 29 or the bottom 9 of the casing. The contact of three of the arms 57 is permanent, whatever the state of the switch device, whilst the contact of a first arm which extends above the wall 59 is interrupted when the operation element 5 is depressed. When the dome center part (55) is depressed the first arm pivots on the wall 59, so its radially outer end lifts off and out of contact with the corresponding conductive region 30.

The operation element 5 rests with its bottom 82 on the insulating block 61 which itself rests on the central portion 55 of the dome-like member. The blocks 83 are engaged in the respective channels 29.

In this configuration, the dome-like member 51 is not in contact with the central pad 21 so that the pad 21 is electrically insulated from the conductive regions 30 at the bottom of the channel 29.

The strap 11 is engaged on the casing 23 and the planar plate 91 constitutes an axial stop for the blocks 83 and, in this manner, prevents the operation element 5 from being withdrawn from the casing 3, similarly to the switch mechanism 7.

The operation element 5 clearly projects upwards from the casing 3 and the LED 13 itself projects upwards from the ring 81 of the operation element 5. The LED 13 is covered by the button 14, which is resiliently engaged on the ring 81 by means of the arms 107.

In this rest configuration, the conductive tabs 90 of the operation element 5 make contact with the respective conductive tracks 33 by means of the lower connecting piece 90B, as indicated above.

The behavior of the switch device when the operation element 5 is activated will now be described. The device has not been illustrated in the activation state thereof, corresponding to the resilient deformation of the switch mechanism 1, and in particular the dome-like member 51. However, the behavior of the device is illustrated by the graph of FIG. 5, to which reference is now made.

On this graph, the values Al of the depression travel of the operation element have been plotted on the abscissa starting from the rest position (in mm) and the values F of the depression effort or resilient reaction applied to the operation element (in N) have been plotted on the ordinate. The depression curve is marked as a solid line and the withdrawal curve is marked as a dot-dash line.

Only the depression curve will be described in detail below.

As has been seen above, the operation element 5 can be activated by means of pressure on the button 14 which is fixedly joined thereto.

When the operation element 5 is depressed in the casing 3 in this manner, over a first axial travel, the insulating block 61 is deformed in compression, as indicated above. At the end of this travel, the dome-like member 51 is abruptly deformed in flexion so that the central portion 55 is urged towards the bottom 9 of the casing. This abrupt deformation is accompanied by a corresponding relaxation of the insulating block 61. The abrupt deformation of the dome-like member corresponds to the substantially vertical curve portion.

This first phase which corresponds to the first axial travel of the operation element 5 is effected in this manner until the central portion-55 of the dome-like member comes into contact with the central pad 21.

At this moment, the switch device reaches a second state of commutation which is characterized by the central pad 21 and one of the conductive regions 30 at the bottom of the channel 29 being adjusted to the same electrical potential, as explained above.

If the user applies additional pressure to the operation element 5, the element 5 continues along the depression travel path thereof in the casing, with the insulating block 61 being compressed, without any significant additional deformation of the dome-like member 51. During this second depression phase corresponding to an additional travel of the operation element 5, the pressing effort on the operation element 5 required for a displacement of given magnitude increases in a very substantial manner.

Naturally, the dome-like member 51 remains in contact with the central pad 21 over this additional travel so that the switch device remains in its second state of commutation.

During the two depression phases which are described above, that is to say, over the entirety of the axial travel of the operation element 5 in the casing 3, contact is maintained between the respective tabs 90 and tracks 33. During the depression, the upper connecting piece 90A is brought into contact with the track 33, the lower connecting piece being kept in contact with that track 33. The upper connecting piece 90A then remains in contact with the track 33, whilst the lower connecting piece 90B becomes separated therefrom, until it reaches its position located in the recess 37. In this manner, a power supply state for the light source 13 can be maintained over the entire travel of the operation element 5, and consequently whatever the state of commutation of the device.

It is also apparent that, over the entire travel of the operation element 5, the relative position of the light source 13 and the button 14 is maintained in an unchanged state. In this manner, the user does not perceive any variation in the luminosity of the source during the activation of the device.

When the pressure on the operation element 5 is released, it will be appreciated that the switch mechanism 7 again takes up, by resilient return of the block 61 and the dome-like member 51 in succession, the initial rest form thereof, with the blocks 83 being repelled and stopped on the lower face of the plate 91.

The switch device then moves back into its first state of commutation, in which the dome-like member 51, and therefore the conductive regions 30 at the bottom of the channel 29, are insulated from the central pad 21, the two regions 30 being electrically connected to each other by means of the dome-like member 51.

During this withdrawal operation, the electrical contact between the power supply tabs 90 and the tracks 33 is also maintained. The behavior of the movable or deformable portions of the device, without being exactly reversible, can be inferred from the above description relating to the depression phases of the operation element, at least with regard to the succession of the various deformation phases. These phases are illustrated by the curve, drawn as a dot-dash line, of the graph of FIG. 5. Naturally, the invention is not limited to a light source as illustrated and other types of light source, and 5 in particular other types of LED, can be used to carry out the invention.

The novel features of the invention are set forth with particularity in the appended claims. The invention will be best understood from the following description when read in conjunction with the accompanying drawings.

What is claimed is:

1. A switch device comprising a casing (3) which has a bottom wall (9), a dome-like member (51) with a dome periphery (57) supported over said bottom wall and with a dome center part (55), a conductive pad (21) lying on said bottom wall under said dome center part, and an operation element (5) which is depressable to downwardly deflect the dome center part (55) against the conductive pad (21) including:

an insulating block (61) of elastomer material which lies between the operation element (5) and the dome center part (55) and which has a lower end that is sufficiently narrow to directly transmit downward forces to the dome center part but not to said dome periphery;

said insulating block having top and bottom surfaces and having a concave outer surface.

2. A switch device comprising a casing (3), an operation element (5) which is upwardly biased and which is depressable to a fully depressed position to move a pair of conductive elements into engagement with each other to close a switch, a light source mounted on said operation element to move with said operation element, a pair of power tracks (33) fixed to said casing, and a pair of contact elements (87) connected to said light source to move with said light source, said contact elements having tabs (90) engaged with said power tracks, wherein:

said tabs each includes a pair of projections (90A, 90B) that lie one above the other, with a lower one of said projection (90B) positioned to engage one of said power tracks when the operation element is not depressed and with the upper one of said projections positioned to engage the power tracks when the operation element is fully depressed.

3. The switch device described in claim 2 wherein:

said operation element is moveable along a vertical axis (Z);

each of said power tracks extends primarily vertically, but at an incline so a lower end of each of the tracks is closer to said vertical axis than is an upper end of each of the tracks.

4. A switch device comprising a casing (3) which has an insulative bottom wall (9), a conductive dome-like member with a dome center part (55) and with a plurality of dome arms (57) radiating from the center part including a pair of opposite arms that radiate in opposite directions from said center part, at least one conductor fixed to said bottom wall and having a first conductive region (30) lying under a radially outer end of a first of said opposite arms, and an operation element (5) which is depressable from a raised initial position downwardly to a lowered position to downward deflect the dome center part (55), wherein:

said insulative bottom wall has an upward projection (59) that lies under a middle of said first arm;

when said operation element is in the raised position said dome center part biases said first arm downward to hold said radially outer end of said first arm down against and in contact with the first conductive region (30), and when said operation element is in the lowered position said first arm pivots on said projection so the arm outer end moves upward and out of contact with said first conductive region.

5. The switch described in claim 4 wherein:

said plurality of dome arms (57) consists of four dome arms angled 90° apart and having outer ends supported over said bottom wall, with only said first arm resting on the upward projection.

6. The switch described in claim 5 including:

a second conductive region that lies under and in contact with the outer end of one of said plurality of dome arms other than said first dome arm.

* * * * *